US009199359B2

(12) United States Patent
Marks

(10) Patent No.: US 9,199,359 B2
(45) Date of Patent: Dec. 1, 2015

(54) HAND SQUEEZE POWERED ROTARY TOOL

(71) Applicant: WORKTOOLS, INC., Chatsworth, CA (US)

(72) Inventor: Joel S. Marks, Sherman Oaks, CA (US)

(73) Assignee: WORKTOOLS, INC., Chatsworth, CA (US)

( * ) Notice: Subject to any disclaimer, the term of this patent is extended or adjusted under 35 U.S.C. 154(b) by 0 days.

(21) Appl. No.: 14/066,417

(22) Filed: Oct. 29, 2013

(65) Prior Publication Data

US 2014/0130640 A1 May 15, 2014

Related U.S. Application Data

(60) Provisional application No. 61/725,983, filed on Nov. 13, 2012.

(51) Int. Cl.

| | |
|---|---|
| ***B25B 17/00*** | (2006.01) |
| ***B25B 13/46*** | (2006.01) |
| ***B25B 15/04*** | (2006.01) |
| *B25B 21/00* | (2006.01) |
| *B25B 15/06* | (2006.01) |

(52) U.S. Cl.

CPC ..... *B25B 13/463* (2013.01); *B25B 15/04* (2013.01); *B25B 15/06* (2013.01); *B25B 17/00* (2013.01); *B25B 21/005* (2013.01)

(58) Field of Classification Search

CPC B25B 21/005; B25B 21/004; B25B 23/0078; B25B 17/00; B25B 17/02; B25B 13/467

USPC ..... 81/57.39, 57.31

See application file for complete search history.

(56) References Cited

U.S. PATENT DOCUMENTS

| | | | |
|---|---|---|---|
| 80,583 | A | 8/1868 | Allard |
| 91,634 | A | 6/1869 | Hofer |
| 157,087 | A | 11/1874 | Allard |
| 201,372 | A | 3/1878 | West |

(Continued)

FOREIGN PATENT DOCUMENTS

| | | |
|---|---|---|
| CN | 2505238 Y | 8/2002 |
| TW | 488348 | 5/2002 |

OTHER PUBLICATIONS

Clifford D. Fales, Zachry T. Furbish and The Forest City Screwdriver Co. The Roots of "Yankee" Screwdrivers, The Chronicle of the Early American Industries Association, Dec. 4, 2003, pp. 132-146, vol. 56, No. 4.

(Continued)

*Primary Examiner* — Hadi Shakeri
*Assistant Examiner* — Danny Hong
(74) *Attorney, Agent, or Firm* — Paul Y. Feng; One LLP

(57) ABSTRACT

A manually powered rotary tool includes improvements to size, drive direction input, drive speed, assembly, strength, and cost. A handle is mounted high in the housing to provide a vertically compact tool. A selector switch controls a spiral ratchet mechanism from outside the housing to better enclose the mechanism and provide improved access to the selecting operation. The ratchet mechanism uses a lateral moving selector bar for effective operation with the external selector switch. The spiral ratchet gears are configured for die cast manufacturing. Various components are of one-piece construction and designed for simplified assembly.

20 Claims, 6 Drawing Sheets

(56) References Cited

U.S. PATENT DOCUMENTS

| | | | | |
|---|---|---|---|---|
| 261,925 | A | | 8/1882 | Herzig |
| 268,938 | A | | 12/1882 | Reid |
| 278,261 | A | | 5/1883 | Olson |
| 301,915 | A | | 7/1884 | Olson |
| 306,096 | A | | 10/1884 | Olson |
| 327,780 | A | | 10/1885 | Fellers |
| 339,277 | A | | 4/1886 | Doolittle |
| 354,359 | A | | 12/1886 | Spencer |
| 355,392 | A | | 1/1887 | Fellers |
| 370,734 | A | | 9/1887 | Fryxell |
| 377,783 | A | | 2/1888 | Shaver |
| 385,414 | A | | 7/1888 | Huber |
| 391,880 | A | | 10/1888 | Cashin |
| 394,169 | A | | 12/1888 | Gosernd |
| 401,604 | A | | 4/1889 | Sutterley |
| 402,538 | A | | 4/1889 | Olson |
| 407,842 | A | | 7/1889 | Schuermann |
| 422,520 | A | | 3/1890 | Greene |
| 428,012 | A | | 5/1890 | Lucas |
| 430,901 | A | | 6/1890 | True |
| 432,729 | A | | 7/1890 | Goodell et al. |
| 447,277 | A | | 2/1891 | Brown |
| 452,772 | A | | 5/1891 | Church |
| 454,929 | A | | 6/1891 | Day |
| 463,506 | A | | 11/1891 | Goodell et al. |
| 464,574 | A | | 12/1891 | Lyorr |
| 468,969 | A | | 2/1892 | Swan |
| 470,001 | A | | 3/1892 | Howard |
| 470,055 | A | | 3/1892 | Jones |
| 470,176 | A | | 3/1892 | Burkardt |
| 484,004 | A | | 10/1892 | Parsons et al. |
| 487,946 | A | | 12/1892 | Edwards et al. |
| 492,693 | A | | 2/1893 | McLoughlin |
| 505,165 | A | | 9/1893 | Hughes |
| 515,327 | A | | 2/1894 | Eggert |
| 520,519 | A | | 5/1894 | Edwards |
| 528,731 | A | | 11/1894 | Morrison |
| 537,681 | A | | 4/1895 | Furbish |
| 543,096 | A | | 7/1895 | Jones |
| 568,341 | A | | 9/1896 | Edwards et al. |
| 568,460 | A | | 9/1896 | Schay |
| 575,734 | A | | 1/1897 | Rauhoff |
| 588,879 | A | | 8/1897 | Rauhoff |
| 591,097 | A | | 10/1897 | Lanfair et al. |
| 593,157 | A | | 11/1897 | Furbish |
| 597,766 | A | | 1/1898 | Furbish |
| 621,401 | A | | 3/1899 | Davis |
| 624,122 | A | | 5/1899 | Stevenson |
| 632,560 | A | | 9/1899 | Furbish |
| 654,150 | A | | 7/1900 | Jedlicks et al. |
| 659,521 | A | | 10/1900 | Furbish |
| 666,508 | A | | 1/1901 | Furbish |
| 674,719 | A | | 5/1901 | Woodruff |
| 711,169 | A | | 10/1902 | Leblanc |
| 722,332 | A | | 3/1903 | Stump |
| 756,388 | A | | 4/1904 | May |
| 791,766 | A | | 6/1905 | Furbish |
| 791,895 | A | | 6/1905 | Furbish |
| 814,528 | A | | 3/1906 | Furbish |
| 819,536 | A | | 5/1906 | Furbish |
| 873,296 | A | | 12/1907 | Chapelle |
| 887,423 | A | | 5/1908 | Pratt |
| 902,957 | A | | 11/1908 | Furbish |
| 924,372 | A | | 6/1909 | Peck |
| 924,878 | A | | 6/1909 | Baron |
| 938,341 | A | | 10/1909 | Ruple |
| 942,571 | A | | 12/1909 | Leland |
| 973,881 | A | | 10/1910 | Rioux |
| 979,132 | A | | 12/1910 | Davis |
| 1,024,960 | A | | 4/1912 | Wolin |
| 1,054,142 | A | | 2/1913 | Plein |
| 1,061,773 | A | | 5/1913 | Nahlinger |
| 1,107,701 | A | | 8/1914 | Plein |
| 1,118,250 | A | | 11/1914 | Wilder |
| 1,183,426 | A | | 5/1916 | Booth |
| 1,259,926 | A | | 3/1918 | Stump |
| 1,290,489 | A | | 1/1919 | Bauer |
| 1,304,714 | A | | 5/1919 | Starrett |
| 1,391,619 | A | | 9/1921 | Edwinson |
| 1,415,251 | A | | 5/1922 | McLean |
| 1,422,411 | A | | 7/1922 | Bonck |
| 1,497,479 | A | | 6/1924 | Booth |
| 1,516,443 | A | | 11/1924 | Leopold |
| 1,563,178 | A | | 11/1925 | Fegley |
| 1,578,866 | A | | 3/1926 | Swain |
| 1,762,315 | A | | 6/1930 | Swain et al. |
| 1,821,194 | A | | 9/1931 | Wilcox |
| 2,301,413 | A | * | 11/1942 | Kilcup ..... 74/57 |
| D136,891 | S | * | 12/1943 | Kost ..... D8/68 |
| 2,421,901 | A | * | 6/1947 | Murad et al. ..... 74/57 |
| 2,708,345 | A | | 5/1955 | Miles |
| 2,708,851 | A | | 5/1955 | Moerk |
| 2,726,563 | A | | 12/1955 | Blackbum |
| 3,286,560 | A | | 11/1966 | Murray |
| 3,557,644 | A | | 1/1971 | Gregory |
| 3,616,714 | A | | 11/1971 | Gregory |
| 3,867,855 | A | * | 2/1975 | Siebert ..... 81/63.1 |
| 3,941,017 | A | | 3/1976 | Lenker et al. |
| 4,108,027 | A | | 8/1978 | Lenker |
| 4,141,262 | A | | 2/1979 | Smith |
| 4,249,617 | A | * | 2/1981 | Cox, Jr. ..... 173/170 |
| 4,524,650 | A | * | 6/1985 | Marks ..... 81/57.39 |
| 4,577,522 | A | | 3/1986 | Cox, Jr. |
| 4,739,838 | A | * | 4/1988 | Marks ..... 173/170 |
| 4,856,385 | A | | 8/1989 | Ogilvie et al. |
| D303,204 | S | * | 9/1989 | Marks ..... D8/51 |
| 5,027,679 | A | * | 7/1991 | Kawashima et al. ..... 81/434 |
| 5,379,873 | A | | 1/1995 | Shiao |
| 5,911,722 | A | * | 6/1999 | Adler et al. ..... 606/80 |
| 6,722,232 | B1 | | 4/2004 | Day |
| 7,137,318 | B2 | | 11/2006 | Falzone |
| 8,985,240 | B2 | * | 3/2015 | Winnard ..... 173/216 |

OTHER PUBLICATIONS

TIPO Official Letter and Search Report of Taiwan, R.O.C., for Patent Application No. 102141059 dated May 25, 2015.

Saint Island Int'l Patent & Law Office, Letter dated Jun. 22, 2015 with English translation of TIPO Official Letter and Search Report.

* cited by examiner 10
120
71
73
70
74a
72
72a
23
25
32
40
70a
103a, 100a
100
230
35, 95
20
90
30
68
31, 65
60
62
93
95

51
54
50
22
24
21
231
33
53

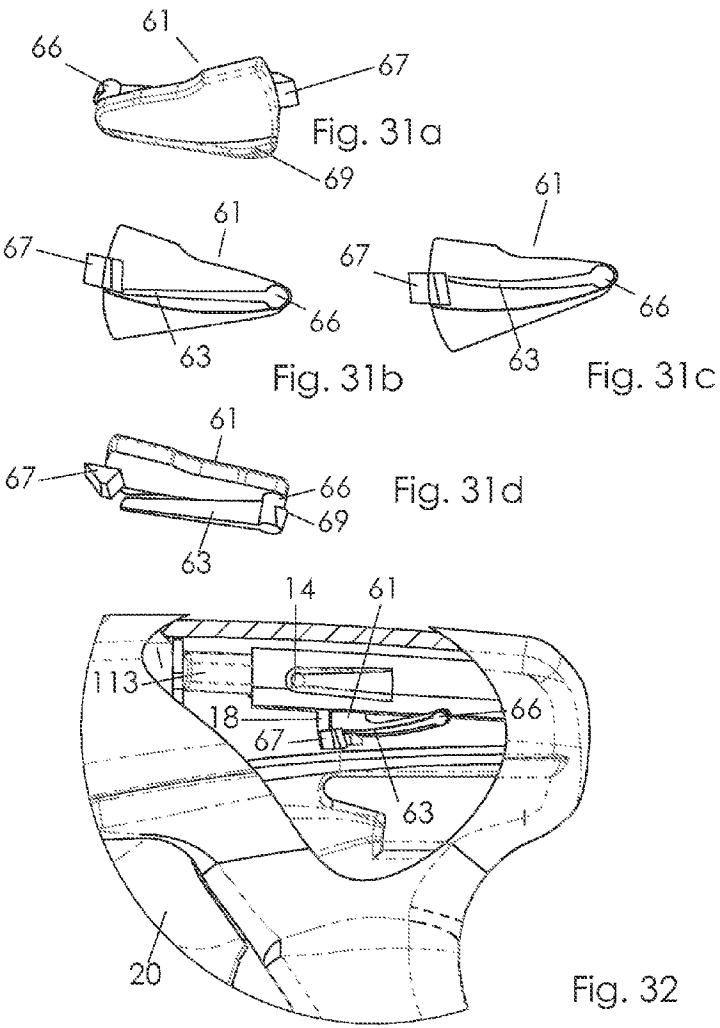
61
66
67
69
Fig. 31a
61
66
63
67
Fig. 31b
61
66
63
67
Fig. 31c
61
66
69
63
67
Fig. 31d
61
66
63
14
67
18
113
20
Fig. 32
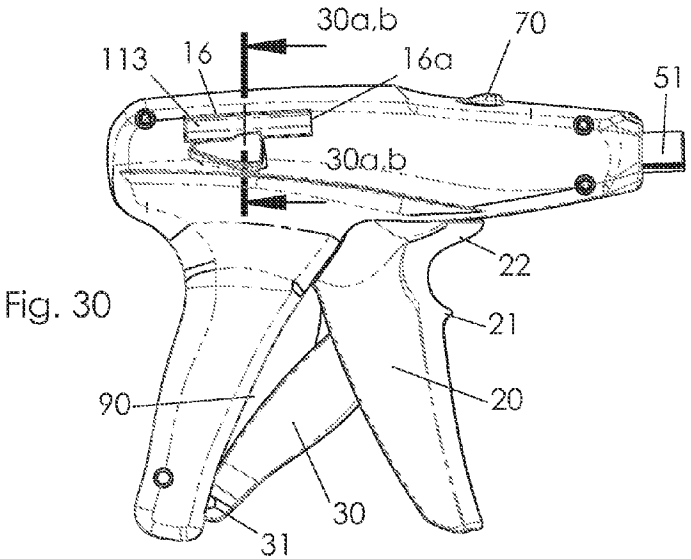
51
70
16a
30a,b
30a,b
22
21
20
30
31
16
113
90
Fig. 30
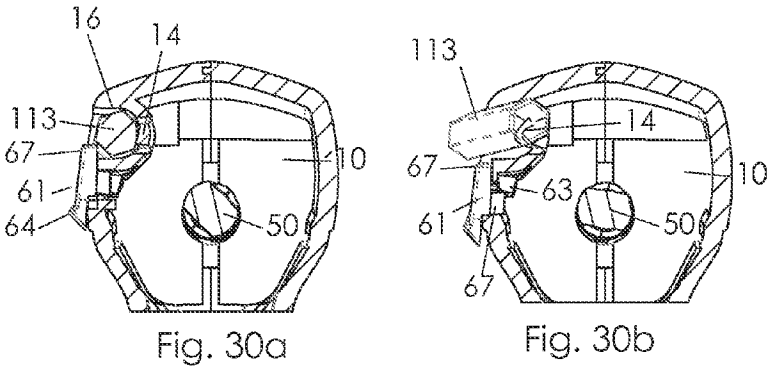
10
50
14
63
113
67
61
67
Fig. 30b
10
50
14
16
113
67
61
64
Fig. 30a

HAND SQUEEZE POWERED ROTARY TOOL

CROSS-REFERENCE TO RELATED APPLICATIONS

This non-provisional application claims benefit of priority from U.S. provisional application No. 61/725,983, filed on Nov. 13, 2012, the contents of which are hereby incorporated by reference.

FIELD OF THE INVENTION

The hand squeeze tool of the present invention is directed to a ratchet action type device. In particular, the present invention provides improvements to a high-speed manual ratchet tool.

BACKGROUND OF THE INVENTION

A high speed, manually powered tool allows for relatively high speed driving, while the operator maintains direct control over the axial force, torque, and turning rate applied to the driven element. In contrast, motorized drivers provide poor control of the rotation speed and torque applied to the driven element. The operator controls a switch, which in turn controls a motor, which finally powers the driven element. The user, accordingly, has little direct control over the events occurring at the driven element. In many instances, this lack of "feel" by the operator causes damage to the driven element and/or to its surroundings, especially in medium and light duty applications.

As disclosed in U.S. Pat. Nos. 4,524,650 and 4,739,838 to the present inventor, a squeeze tool serves to convert squeezing motion into rotary motion on a variable torque basis, and serves to transmit the rotary motion to a screw, bolt, or other fastener, which is being tightened or loosened. The tool incorporates a pull lever and a varying force transmitting lever which operate in conjunction with a squeeze handle to provide a traveling fulcrum, so that when the squeeze handle is squeezed, maximum torque and minimum speed are generated at the beginning of the stroke, and maximum speed and minimum torque are realized for the remainder of the stroke. However, these prior designs are not compact, require many components, have limited torque to failure, and are unnecessarily expensive to produce. Further, the action required to change rotation direction is not efficient, requiring inserting a finger into the internals of the tool.

Other manual rotary tools have used gear amplification to convert squeezing action to rotary motion. However, such designs require complex structures to provide ratcheting action and reversible direction and are of limited strength.

SUMMARY OF THE INVENTION

The present invention is directed to a compact, low cost, and sturdy rotary tool. In a preferred embodiment, the tool comprises a housing containing a rotatable shaft with a drive fitting at front. A handle is pivotally attached to the housing and extends, preferably but not necessarily downward, from the housing. Preferably an intermediate curved lever links the handle to a sliding ratchet mechanism. The mechanism slides along the shaft and converts the sliding motion to rotary shaft motion, in the exemplary embodiment, through a spiral ratchet system. Pressing or squeezing the handle thus causes the drive fitting to rotate.

The vertical height is reduced through an elevated handle mounting whereby the handle hinges at or above the shaft axis and preferably has a bridge connecting two sides of the handle above the sliding ratchet mechanism. The handle is preferably a single piece part with built in pivot bosses.

The ratchet mechanism uses a lateral latch motion of a selector bar to provide a long ratchet tooth engagement. The lateral action also makes practical an externally mounted selector switch whereby such switch can move the selector bar in this lateral direction.

The switch is attached to the housing, while the mechanism normally moves separately from the switch. The switch toggles between selected positions corresponding to a desired shaft rotation direction. As illustrated in the drawings, the switch links to the selector bar of the mechanism in a rest position of the tool. When the mechanism moves rearward in a driving stroke, the switch and mechanism are spaced apart and de-linked. In this manner, the switch can remain in a same position on the housing for any operative position of the mechanism.

In the preferred embodiment, the switch may be moved while the mechanism is not linked thereto. For example, with the mechanism in a rear position of a stroke and the switch normally mounted at a front of the housing the switch may be moved even though it does not immediately affect the state of the mechanism. When the mechanism returns forward to its rest position, it comes to engage the switch in the new switch position. The switch remains stationary and presses the selector to change direction by a cam action.

According to the above description, the mechanism direction is changed indirectly through a switch mounted in a fixed manner to the housing. Therefore, there need not be an opening in the housing that would expose the mechanism for direct access. It may be desired that the switch include or comprise an elongated structure that engages the selector bar or equivalent structure of the mechanism. For example, the switch may extend externally or internally to the housing along a length of the shaft to provide continuous or nearly so engagement for all positions of the mechanism. In any of these examples the switch retains the indirect linkage to the mechanism whereby the mechanism need not be directly exposed outside the housing for the purpose of access to it.

Various components include simplified structures for easier assembly and lower cost as described in the detailed description.

BRIEF DESCRIPTION OF THE DRAWINGS

FIG. 29*a* shows the lower link positioned near the curved lever before assembly.

FIG. 29*b* shows the lower link in an intermediate assembly position.

FIG. 29*c* shows the lower lever and link in a normal operative position.

FIG. 30 is a right, side elevational view of the rotary tool.

FIG. 30*a* is a cross-sectional view taken along line 30*a,b*-30*a,b* of FIG. 30 showing a drive bit retainer.

FIG. 30*b* shows the drive bit of FIG. 30*a* partially released from the retainer.

FIGS. 31*a* to 31*d* are perspective views of a bit retainer latch.

FIG. 32 is a broken-out, cross-sectional view of the rotary tool showing an internal view of the drive bit retainer.

DETAILED DESCRIPTION OF THE PREFERRED EMBODIMENTS

Figures 1, 2, 3:
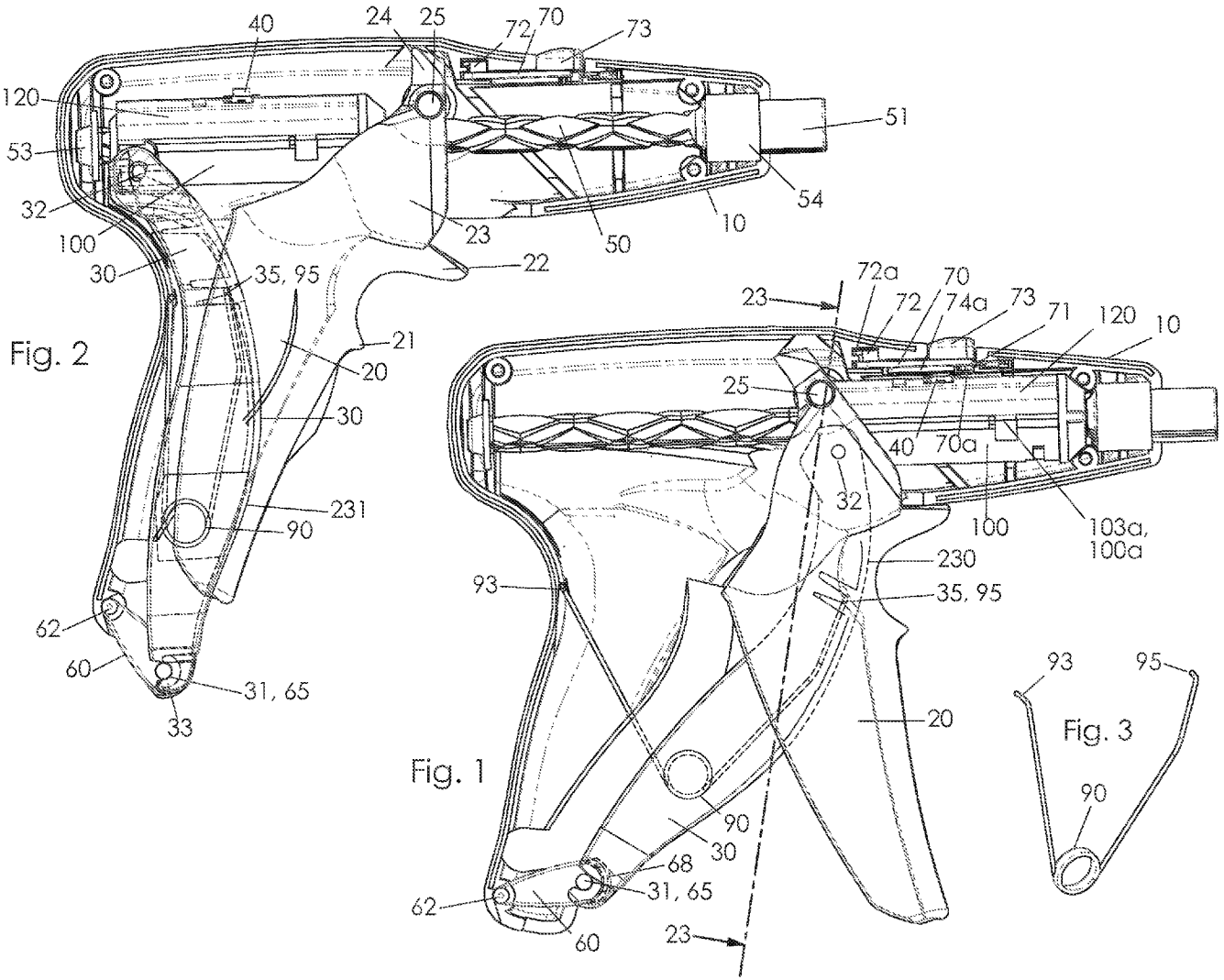
FIG. 1 is a side elevational view of a preferred embodiment rotary tool in a rest position with a right housing half removed to expose internal parts.
FIG. 2 is the rotary tool of FIG. 1 in a rear operative position.
FIG. 3 is a perspective view of a re-set spring.
Figure 5:
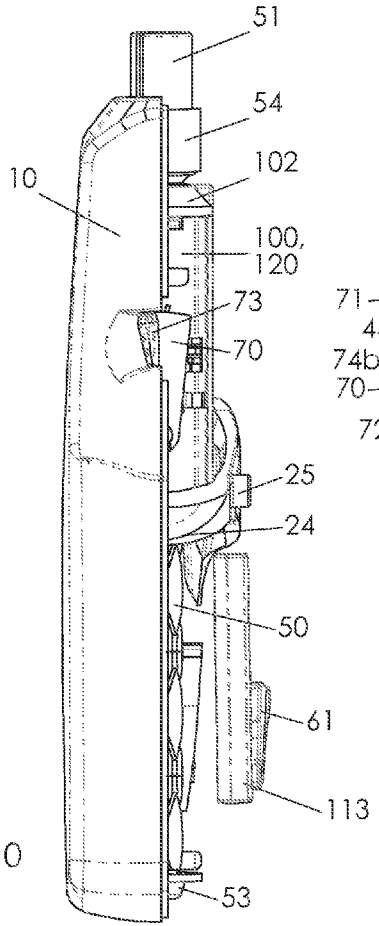
FIG. 5 is a top view of the rotary tool of FIG. 1.
Figure 4:
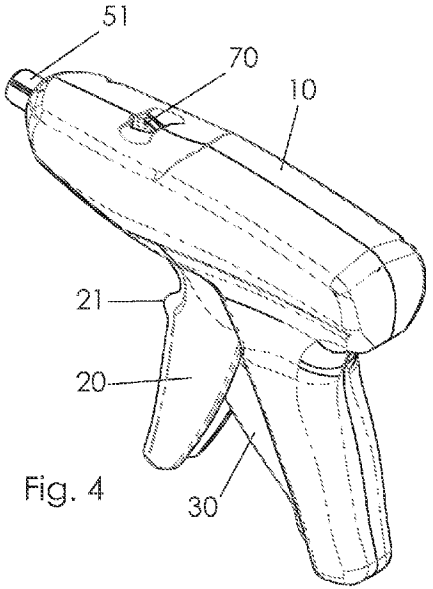
FIG. 4 is a top, rear left side view of the rotary tool of FIG. 1 including a right housing half.

The present invention is directed to a manually operated, high speed ratcheting tool. The drawing figures illustrate preferred embodiments of such a tool. In FIGS. 1 and 2, housing or, equivalently referenced, body 10 includes an elongated upper portion. Within the upper portion is elongated spiral cut shaft 50. Spiral shaft 50 may be produced by machine cutting, die-casting, forging, stamping, or the like. Drive tip 51 is attached to the front of shaft 50. In the case that shaft 50 is die cast tip 51 may be formed integrally with shaft 50 in the same mold cavity. Tip 51 preferably has a hexagonal sectioned recess (not shown) although other structures to mate with drive bits may be used. Front bearing 54 and rear bearing 53 hold shaft 50 rotatably within housing 10. Left and right references in this disclosure are with respect to the top views of FIGS. 5 to 7 although certain views may be discussed otherwise with respect to the page.

Drive means or mechanism 100, detailed in FIGS. 11 to 22, slides along shaft 50. The preferred drive mechanism is a spiral ratchet type, although other structures to convert linear motion to rotating motion may be used, for example, a gear or cam system. Pressing handle 20 causes mechanism 100 to move rearward, toward the position of FIG. 2. More generally, mechanism 100 moves in a drive direction to cause shaft 50 to rotate in a selected direction. Re-set spring 90 biases the mechanism to return forward in a return direction to the position of FIG. 1. Other geometries (not shown) may have the drive direction of the mechanism being forward with the return being rearward.

Figure 27:
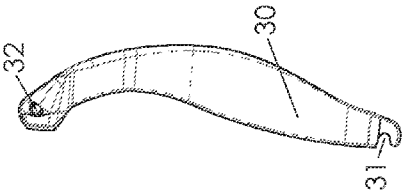
FIG. 27 is a side elevational view of a curved lever.

Curved lever 30 (FIGS. 1, 2, 27) in a preferred embodiment is an intermediate link between mechanism 100 and handle 20. This interaction allows varying leverage upon the mechanism through a "traveling fulcrum." That is, in forward positions near that of FIG. 1, curved lever 30 links to handle 20 near upper fulcrum 230. In rear positions, such as that of FIG. 2, the fulcrum moves to be at or near lower fulcrum 231. A relatively large motion of handle 20 produces a small motion of mechanism 100 with upper fulcrum 230. Therefore, the handle stroke starts with high leverage and thus high torque acting upon drive tip 51. At the end of the stroke, lower fulcrum 231 operates and a small motion of handle 20 produces a relatively large motion of mechanism 100. This corresponds to a high-speed portion of the stroke. With the traveling fulcrum, hand power provides both high breaking torque and high-speed driving. The traveling fulcrum further ensures ergonomic application of the user's hand grip force. That is, a person's gripping strength varies depending upon his or her partially open or closed hand, and the present invention tool requires high force to low force corresponding to the leverage and force able to be applied by the user's open or closed hand grip positions.

Further, the preferred spiral ratchet mechanism 100 provides simple ratchet operation. In this operating mode, a user twists the entire tool body back and forth in a conventional ratchet type motion. This third operational mode provides the highest torque capability, practically limited only by the strength of the mechanism.

Figure 23:
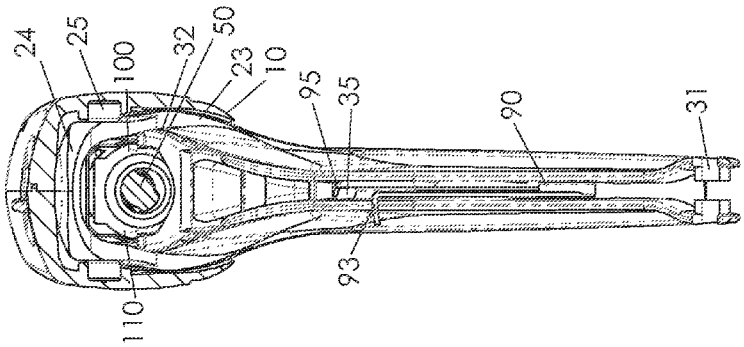
FIG. 23 is a cross-sectional view taken along line 23-23 from FIG. 1.

Curved lever 30 is pivotally attached to mechanism 100 assembly at lever pivot 32. The lower end of the curved lever attaches to lower link 60. As shown, lever pivot 32 is slightly below the axis of shaft 50. Handle 20 is pivotally attached to housing 10 at handle pivot 25 at a location above shaft 50. With lever pivot 32 and handle pivot 25 substantially vertically separated (FIG. 1), they can be horizontally proximate as best seen in FIG. 23. If the handle pivot were vertically near the lever pivot, for example below the shaft axis, then the housing must be widened to accommodate both aligned structures. As shown in the preferred embodiment, the structure can be very compact.

Lower link 60 provides a link to accommodate the change in distance between mechanism 100 and a bottom of housing 10, for example at pivot 62 in FIG. 1. It is configured to cancel vertical forces on curved lever 30 from handle 20. This avoids excess friction between mechanism 100 and shaft 50 as the mechanism slides along the shaft; specifically the forces remain primarily directed rearward. For example, handle 20 is pushing curved lever 30 upward at fulcrum 231 in FIG. 2. Lower link 60 is pulling down on curved lever 30 at link pivot 65 corresponding to pivot 31 of curved lever 30 since pivot 31 biases link 60 rearward here. The preferred geometries shown, in their similar relative proportions, provide effective force cancellation at shaft 50.

Figure 29C:
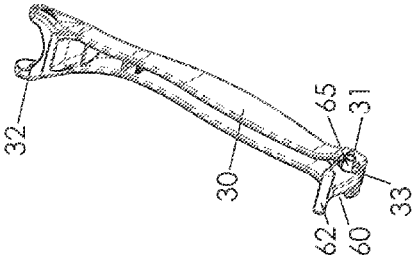
FIGS. 29*a* to 29*c* show, in a rear perspective view, preferred steps for assembly of the lower link to the curved lever.
Figure 29B:
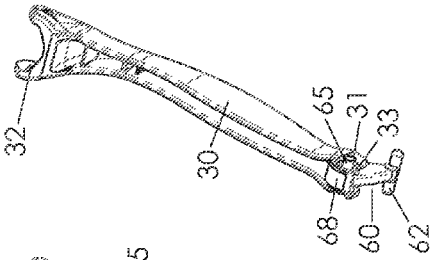
Figure 29A:
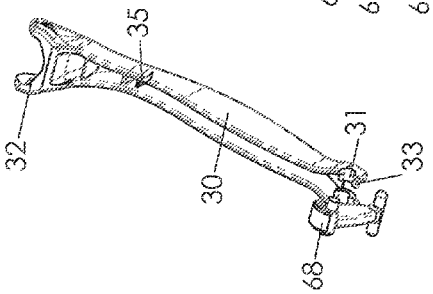
Figure 28:
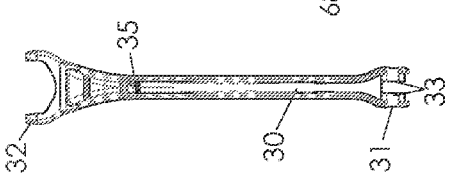
FIG. 28 is a rear elevational view of the lever of FIG. 27.

To assemble lower link 60 to curved lever 30 no additional fasteners or parts are required. FIGS. 26 and 29*a* to 29*c* show lower link 60 and its assembly to curved lever 30. Lower link 60 includes front pivot 65, attached to curved lever 30, and rear pivot 62, attached to housing 10. In front of front pivot 65 is rib 68. As shown rib 68 is concentric around front pivot 65 although it may form other shapes. Rib 68 locks link 60 to curved lever 30. In FIG. 29*a* link 60 is in a pre-assembly position near curved lever 30. At recess 31, concentric rib 33 extends inward, FIG. 28. Lower link 60 is initially installed reversed direction from its final position. The link is moved toward curved lever 30 until the post of pivot 65 is in the recess of pivot 31 (FIG. 29*b*). Link 60 is then rotated around to its normal position (FIG. 29*c*), where rib 33 retains the link in position at pivot 31 against link rib 68. A rear face of rib 68 slidably contacts a front face of rib 33 to lock the link in place through its normal range of motion.

Figure 26:
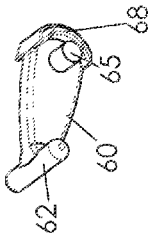
FIG. 26 is a rear perspective view of a lower link.

Lower link 60 is depicted with a thin central portion, as seen in FIGS. 26 and 29*a*. Optionally, it may have a laterally extending rib (not shown) in and out of the page of FIG. 1. Such rib would follow lengthwise along the bottom of lower link 60 and fill the opening at the bottom of the housing. This opening is seen in FIG. 23 near and under pivot 31. In this instance, housing 10 of FIG. 1 would be shortened to coincide with this lower link rib. The resulting structure would provide a smooth closed bottom end to the tool in the rest position of FIG. 1 with lower link 60 forming an optional cosmetic cap to the bottom end of housing 10.

For any geometry of the present invention rotary tool, it is preferable to avoid large angular changes of handle 20 through a stroke, which can introduce unwanted friction and drag into the system. Therefore, the pivot location should be spaced as far as practical from the grip area. In this manner, a given linear (rearward) motion at upper fulcrum 230 should require a least amount of angle change to the handle. One way to achieve this large spacing is to make the handle and corresponding housing portion extend downward as far as required. However, it is also preferable to provide a vertically compact tool. Therefore, it is one preferred feature of the invention that a handle structure provides a high mounting of the handle in the housing. Specifically, the high mounting implies handle pivot 25 is located above the axis of shaft 50. As seen in FIGS. 1 and 2, handle pivot 25 is located almost entirely above shaft 50 while curved lever pivot 32 is preferably below handle pivot 25 and beneath shaft 50. With a high mounting, a relatively long handle thus extends minimally downward from housing 10. As illustrated, the top of the grip provides a practical amount of handle motion, and thus leverage, being distant from handle pivot 25. In this arrangement, the upper end of the grip area is adjacent or nearly so to the bottom of the housing upper portion.

According to the exemplary construction described above, there are three elements aligned horizontally above the center rotational axis of shaft 50. As seen in FIG. 23, cylinder 110 of mechanism 100 extends immediately above and beside shaft 50. Handle sidewalls 23 are the next "layer" beyond shaft 50. A final, outermost layer is housing 10. Innermost "layer" shaft 50 rotates while the second layer of mechanism 100 axially reciprocates. The third layer of handle sidewalls 23 reciprocates pivotally. Outer layer housing 10 is stationary in relation to the inner layers. As seen in FIGS. 1 and 2, mechanism 100 including cylinder 110 may have a rest position extending substantially forward from handle pivots 25 (FIG. 1). The rear position of FIG. 2 may have the mechanism largely or entirely rearward of the handle pivots. The disclosed preferred embodiment structure thus provides for the motions described in a highly compact assembly.

Figure 25:
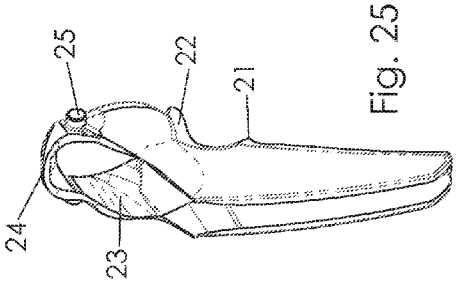
FIG. 25 is a right rear perspective view of the handle of FIG. 24.
Figure 24:
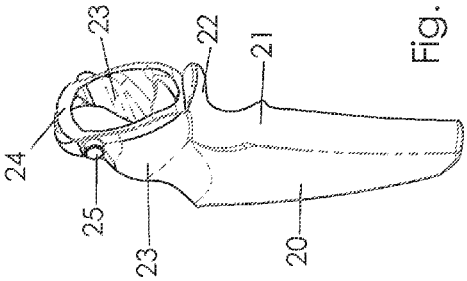
FIG. 24 is a right, front perspective view of a handle.

In FIGS. 23 to 25, the exemplary handle pivots 25 are bosses extending from the handle structure. Theses bosses fit corresponding pivot recesses of housing 10. These pivots may instead be recesses in the handle or other suitable features. Handle sidewalls 23 surround mechanism 100 and preferably fit between the drive mechanism and the inside of housing 10. These sidewalls 23 therefore should preferably be as thin as practical for a compact tool. Yet to maintain a rigid structure at pivots 25, the handle preferably includes bridge 24 to connect sidewalls 23. Bridge 24 provides a compressive link or support to keep sidewalls 23 from deflecting inward when handle 20 is squeezed. Handle 20, through sidewalls 23 or equivalent, thus surrounds both shaft 50 and mechanism 100 up to and preferably past the shaft axis and further preferably up to or past the top of shaft 50. Handle 20 further may surround these structures from above through bridge 24. In an operational stroke, mechanism 100 moves substantially or entirely through and past the surrounding handle structures of sidewalls 23 and, when provided, bridge 24. This is seen in FIGS. 1 and 2. In FIG. 1, mechanism 100 extends forward between and under the upper portions of handle 20 whereby mechanism 100 and shaft 50 are effectively coaxial within the upper handle. In FIG. 2, mechanism 100 has moved rearward and is spaced rearward from these handle structures.

Optionally, sidewalls 23 may be held from deflecting inward by holding the bosses pivotally to the inner wall of housing 10. For example, a screw, stake, rivet, roll pin, snap ring, or equivalent structure (not shown) may hold the boss from pulling out of its pivot mounting. Such fastener may be installed from outside the housing in which case it would normally be exposed externally. Further, the boss may be held by an undercut notch in the boss that fits to a rib of the housing pivot recess (not shown). These holding features may operate instead of or in supplement to bridge 24.

The features of the preferred drive or ratchet mechanism 100 are shown in FIGS. 11 to 22. Cylinder 110 (FIG. 14) forms a core structure. It may be a die cast material, sintered, machined, forged, welded sheet metal, or other like process, or reinforced plastic or fiberglass. It need not be precisely cylindrical. Cylinder front bearing 103 fits at the front of cylinder 110, while shaft 50 (FIG. 15*a*) rotates relative to the sliding, linearly translating cylinder. Within cylinder 110 are preferably two ratchet gears 80. The gears 80 are normally of hollow cylindrical shape and include external ratchet teeth 82 with internal helical ribs 85. Ribs 85 fit to corresponding cut grooves of shaft 50, being opposed in direction for each gear 80. Therefore, engaging one gear provides a first rotational direction to shaft 50 while engaging the other gear provides a second rotational direction. Engaging both at the same time would provide a non-rotating condition.

Figures 11, 12, 13, 14, 15, 15A, 15B, 16, 17, 18A, 18B, 18C:
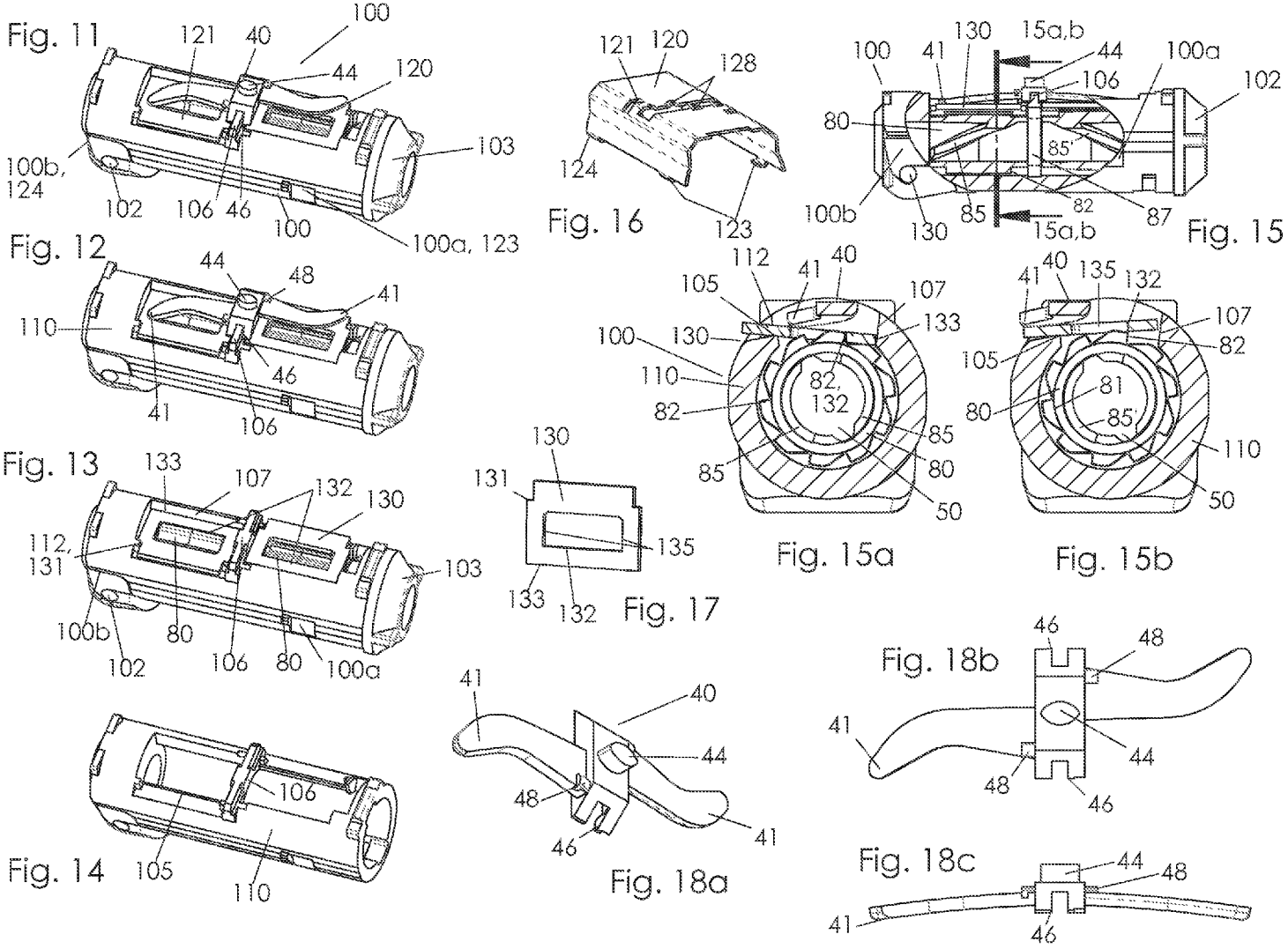
FIG. 11 is a top, right front perspective view of a ratchet mechanism.
FIG. 12 is the mechanism of FIG. 11 with the cover removed.
FIG. 13 is the mechanism of FIG. 12 with the selector bar removed.
FIG. 14 is the mechanism of FIG. 13 with the latches and front bearing removed.
FIG. 15 is a right side elevation view of the mechanism including a broken-out section view.
FIG. 15*a* is a partial section view of the mechanism of FIG. 15 with the latch engaged to a gear.
FIG. 15*b* the view of FIG. 15*a* with the latch disengaged from the gear.
FIG. 16 is a front right perspective view of the mechanism cover.
FIG. 17 is a perspective view of a latch.
FIG. 18*a* is a top perspective view of a direction selection bar.
FIG. 18*b* is a top view of the bar of FIG. 18*a*.
FIG. 18*c* is a front elevational view of the bar of FIG. 18*a*.

Outer teeth 82 provide the gear engagement. A latch 130 (FIG. 17) selectively engages and locks to the teeth 82 to prevent rotation of the gear in one direction. There are preferably two latches 130 (FIG. 13), each to prevent rotation in a respective clockwise or counterclockwise direction of ratchet gears 80 and shaft 50. Simultaneous activation of both latches 130 (not shown) can provide the non-rotating condition in either direction. FIG. 15*a* illustrates an example with a rear gear 80 engaged with latch 130. Latch 130 pivots or tilts about a pivot axis or edge 105 of cylinder 110 (see also FIG. 14). Latch 130 is preferably flat at edge 105 with cylinder 110 chamfered as shown in FIGS. 15*a* and 15*b* to allow free motion of latch 130. The flat latch 130 enables a vertically compact feature in this area. Pivot axis or edge 105 is elongated along the length of cylinder 110. It is preferred to space pivot axis 105 as far as possible away from the gear engagement. This spacing may be called a latch pivot arm length. As shown in FIG. 15*a*, this latch pivot arm length is the distance from edge 105 to latch edge 132. Latch edge 132 faces an opening of latch 130 and is substantially past the center lines of cylinder 110 and shaft axis 50, to the right in the FIG. 15*a* view. With a large pivot arm length, there is minimal angular change in latch 130 as it rides up and down the gear teeth. This ensures that latch 130 is well controlled on its pivot mounting near edge 105 with predictable engagement to gear teeth 82 and to the latch mountings on cylinder 110 (FIGS. 15*a*, 15*b*). To mount latch 130, notch or edge 131 abuts corresponding tab 112 of cylinder 110 (FIGS. 13, 17). As gear 80 rotates freely counterclockwise in FIG. 15*a* toward the gear position FIG. 15*b*, notch 131 of latch 130 lightly presses tab 112 to hold the latch in its lateral position through its flapping type motion. Preferably, notch 131 with tab 112 is closely aligned to edge 105 with respect to the horizontal direction in FIG. 15*a* to prevent excess sliding from vertical latch motion at tab 112. The long pivot arm length also reduces sliding from angular motion of latch 130. These features reduce friction in the latch action. In FIG. 15*b*, latch 130 at latch edge 132 is just ready to fall into engagement with gear tooth 82.

Figure 21:
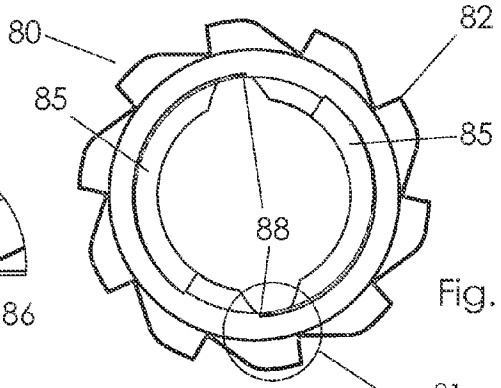
FIG. 21 is an end view of the gear of FIG. 19.
Figure 21A:
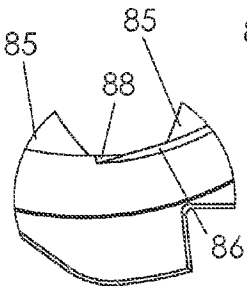
FIG. 21*a* is a detail view of FIG. 21.
Figure 22:
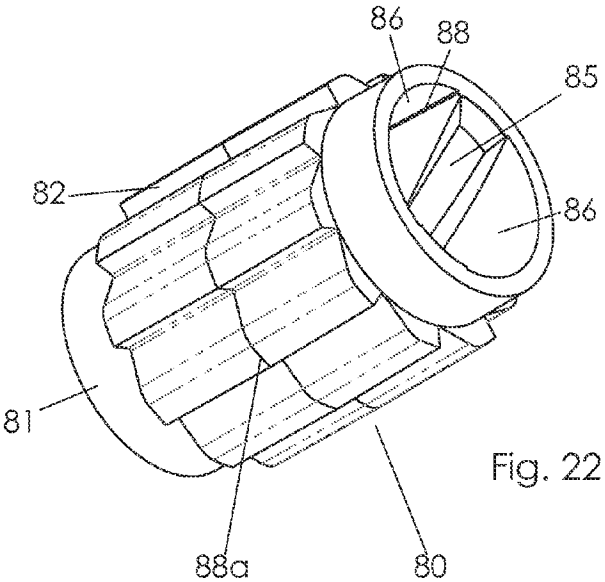
FIG. 22 is a perspective view of the gear of FIG. 19.
Figure 19:
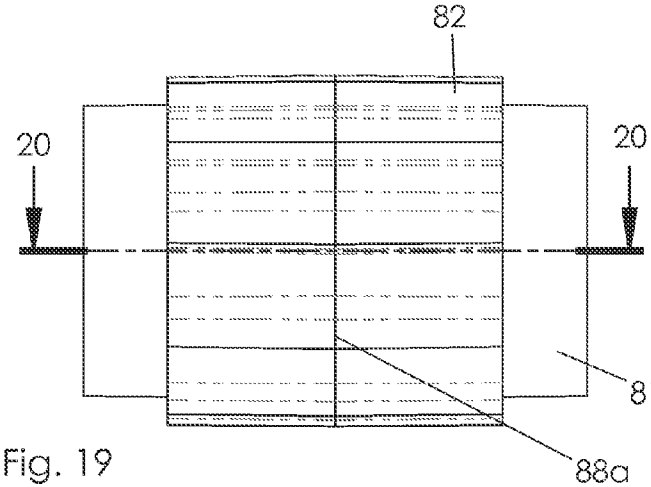
FIG. 19 is a side view of a ratchet gear.
Figure 20:
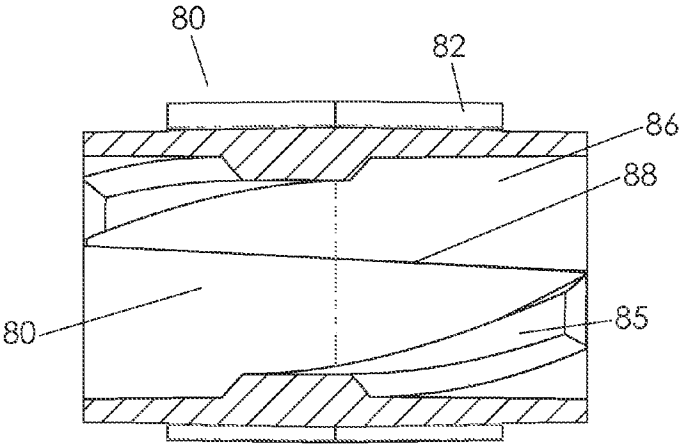
FIG. 20 is a cross-sectional view taken along line 20-20 of the gear of FIG. 19.

In the preferred embodiment, gears 80 (FIG. 22) include structures compatible with low cost die cast production methods. Typically, these parts have been conventionally fabricated from bronze by a complex series of machining steps including lathe turning and broaching. In contrast, departing from conventional wisdom, the preferred embodiment gears of the present invention include parting lines 88 and 88*a* describing mold separation areas (FIGS. 19 to 22). Parting line 88*a* extends around the outer circumference of gear 80 with teeth 82 drafted away from this line. To form the interior helical ribs 85, parting line 88 separates two mold cores. Preferably, parting line 88 (FIG. 20) is at least about three degrees off the cylindrical axis of gear 80, although less draft may be used. As shown, the core can be produced by a straight pull of the mold rather than a refraction that twists with the helix of ribs 85 although a twisting refraction may be used if desired. Along with the face at parting line 88, core face 86 is also drafted. Accordingly, parting line 88 and face 86 are entirely visible from the pull direction in FIG. 21—see also the detail view of FIG. 21*a*, with no hidden undercuts in this view. Shoulders 81 provide clearance for connecting structures 135 of latch 130 as seen in FIG. 15*b*.

Preferably, gears 80 are made from or includes die cast metal alloys including zinc, with high aluminum zinc alloys being more preferable. For example, the alloy may be preferably composed of between about 8% to 27% aluminum, which range includes all quantities in between and the outer limits of the range. Other die cast materials may be used including copper alloys such as bronze. Further, gears 80 may be produced by sintered metal processes. The drafted parting lines shown are beneficial for all of these simplified processes.

When shaft 50 is biased to rotate clockwise in FIG. 15*a*, gear tooth 82 presses latch edge 132 so gear 80 cannot rotate in that direction. This is a locked condition of latch 130 as latch edge 133 reacts against wall 107 of cylinder 110 (FIG. 15*a*). As mechanism assembly 100 is forced to slide along shaft 50, into the page of FIG. 15*a*, helical rib 85 of rear gear 80 urges the shaft to rotate clockwise. Depending on the orientation of the helical rib, the rotational bias on the shaft is either clockwise or counterclockwise. Front gear 80 has helical rib 85' while rear gear 80 has helical rib 85 (FIGS. 15*b*, 15*a*). A reversible rotary tool therefore normally has two opposed internally helical gears, but fewer or more are contemplated.

Cylinder cover 120 encloses mechanism 100 from the top (FIGS. 11 and 16). In conventional designs, this cover wraps around the cylinder. Such a cover is expensive to produce and not easily installed. In contrast, the preferred embodiment cover 120 snaps onto cylinder 110 from the top. Hooks or tabs 123 and 124 snap fit to corresponding recesses or ribs 100*a* and 100*b*. Tab 121 extends downward to be proximate to latch 130. Tab 121 is closely laterally aligned with pivot edge 105 to secure latch 130 in its downward position in the assembly while allowing free pivoting of the latch through its full angular motion.

Laterally sliding or moving a direction selector bar 40 (FIGS. 18*a*-18*c*) by the user controls the position and action of latches 130. FIGS. 12 and 15*a* show direction selector bar 40 moved to a left position as defined earlier with respect to FIGS. 5 to 7. This is toward the top of the page in FIG. 12, and toward the right as seen on the page of the rear cross-sectional views of FIGS. 15*a* and 15*b*. Preferably, selector bar 40 is made of or includes molded resilient material such as acetal plastic or similar polymer. Other resilient materials or components may be used, for example, metallic flat or wire spring elements. The bar is preferably a single piece component. Arms 41 extend from a central structure (FIG. 18*a*). Preferably, arms 41 are symmetric elongated features and include a tapered section, decreasing in cross-sectional area away from the attachment location. As constructed, arms 41 are preferably resilient and able to control the action of latches 130. Arms 41 may be separate structures such as metallic springs.

In the view of FIG. 15*a*, arm 41 presses latch 130 to the right side of pivot edge 105 (with respect to the page). This corresponds to the left position as previously defined with respect to FIGS. 5-7. The resilience of arm 41 thus biases latch edge 132 downward to engage a tooth 82. In FIG. 15*b*, bar 40 has been moved to the left in the drawing, its right side position as defined above, from edge 105 in the tool. Latch 130 pivots about edge 105 to move latch edge 132 up and out of engagement with tooth 82 so that gear 80 is free to rotate in either direction. Since there are two opposed arms 41, selector bar 40 cannot rock out of position, with respect to the view of the selector bar in FIG. 15, from its applied biasing forces. Arms 41 selectively provide both the resilient bias to hold the latches engaged and a force to hold the latches disengaged.

The central portion of selector bar 40 optionally includes an elongated channel or rib 46, or equivalent structure, whereby the selector bar is guided or slides upon cross member 106 of cylinder 110. Channel 46 is elongated as seen in FIG. 18*b* to span a distance that is a substantial portion of the lengths spanned by arms 41. For example, it is more than half the length as shown. In this manner, selector bar 40 can slide smoothly on cross member 106 without twisting or binding from any externally applied forces. Preferably, channel 46 extends along a majority of cross member 106.

Cross member 106 also provides added strength to the structure of cylinder 110. As torque is applied to gear 80, latch 130 tends to spread the walls of cylinder 110. A limitation of the torque capacity of the system can be a result of this deformation. To provide a sturdy structure, cross member 106 ties each side of cylinder 110 together to prevent such deformation, with gears 80 front and rearward of cross member 106. Under cross member 106 is an optional washer 87, which separates the two gears 80 (FIG. 15). Washer 87 is installed from the front of cylinder 110 and normally fully surrounds shaft 50. It may be made from a low friction material such as acetal or the like.

Cover 120 includes detents 128 or equivalent structures to maintain a selected position for selector bar 40. The bias from resilient arms 41 presses bumps 48 into the detents. Selector bar 40 thus clicks into or otherwise releasably holds its lateral position against small forces.

Figure 6:
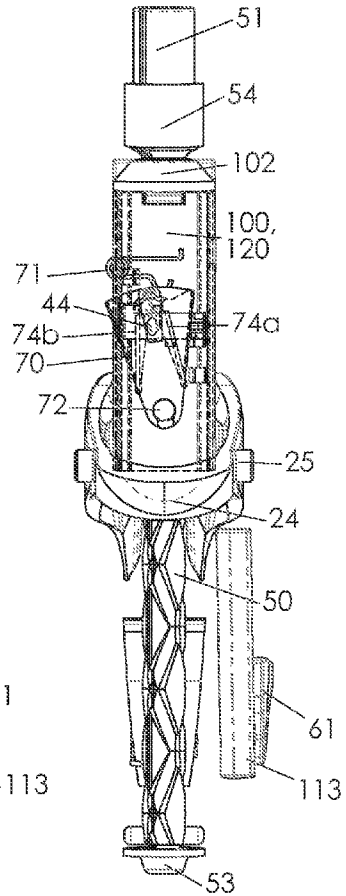
FIG. 6 is the view of FIG. 5 with the left housing removed and hidden lines shown for some parts.
Figure 8:
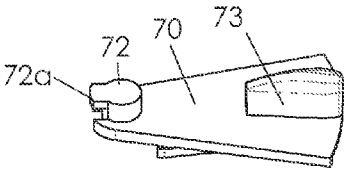
FIG. 8 is a top right side perspective view of a selector switch.
Figure 9:
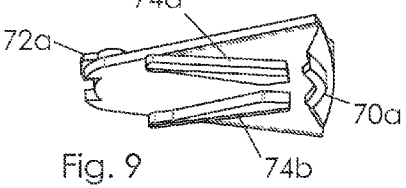
FIG. 9 is a bottom right perspective view of the switch of FIG. 8.

One such force on selector bar 40 may be that applied to post 44 (FIGS. 11, 15, 18*a*). Post 44, or equivalent structure, extends upward, or is otherwise accessible, from mechanism 100 (FIG. 11). Moving post 44 laterally, sideways as seen in FIG. 6, selects the desired direction for the rotation of shaft 50. In conventional spiral ratchet designs, a lengthwise motion, up and down the page in FIG. 6, selects the direction. However, a sideways motion is suited to provide an optional, externally exposed selector switch 70 (FIGS. 8, 9). Selector bar 40 along with parts that are operated by it such as latches 130 may be referred to as a direction selector. Equivalent structures are also included in the description of a direction selector. The direction selector is thus operable to determine a direction of rotation of shaft 50 upon linear or sliding motion of mechanism 100. Further, FIG. 6 depicts the tool as it is seen by the user when held in his or her hand. The left or right sideways motion or position (instead of an upward or downward lengthwise motion or position) of the selector switch 70 in FIG. 6 thus helps the user remember with a visual cue which direction (clockwise or counterclockwise) is locked down without having to manually check.

Optionally selector bar 40, or equivalent structure, may rotate about cylinder 110. For example, a component linked to the latches may rotatably slide or move about an exterior of the cylinder. The cylinder may itself rotate to selectively actuate or disengage the latches.

Selector switch 70 is pivotally or movably mounted to housing 10. It provides an interface to provide external access to the mechanism and communicate a user's action from outside the tool to the mechanism. This is advantageous over conventional rotary tool designs wherein a user must directly access an interior of the tool to operate a direction selector, with such access available only in certain mechanism positions. In the exemplary embodiment, selector switch 70 remains in a mostly fixed location of housing 10, moving only to the extent required between selected positions. Pressing on rib 73 (FIG. 5) easily operates it where rib 73 is exposed externally for all positions of mechanism 100 even as selector switch 70 is preferably linked to the mechanism for only certain sliding positions of the mechanism.

Figure 7:
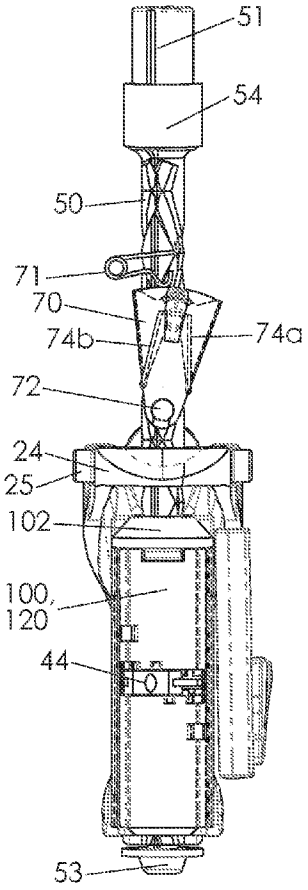
FIG. 7 is the view of FIG. 6 with right direction selected and the mechanism in the rear position of FIG. 2.

As shown in FIGS. 1 and 6, selector bar 40 is below and able to contact selector switch 70. Selector ribs 74*a* and 74*b* selectively contact and/or move post 44 of selector bar 40. Preferably, post 44 is confined or pressed in a manner as shown such that toggling selector switch 70 also toggles selector bar 40 in or near the forward mechanism position. In FIG. 6, the left positions are selected. Moving switch 70 to the right therefore causes selector bar 40 to slide to the right. In FIG. 7, mechanism 100 is rearward and spaced from selector switch 70, with selector switch 70 moved to the right side position. The selector switch and bar are described with regard to respective left and right positions. This is with respect to the illustrated embodiment with the switch on top. If the respective parts are mounted in a different rotational position on the body or housing 10, for example on a side, then left and right may be considered to relate to the rotational direction about shaft 50.

Selector switch 70 is normally out of contact with the direction selector bar 40 in the rear mechanism positions as in FIG. 7 (see location of post 44 spaced away from switch 70). However, it is still normally possible to change the position of switch 70 even as there is no immediate effect on mechanism 100. For example, switch 70 may have been moved to the right after mechanism 100 had moved to the rear position. Direction selector bar 40 normally temporarily remains in the left position, as shown. In this instance, selector switch 70 will act upon mechanism 100 as the mechanism returns to approach its forward rest position. Raised selector ribs 74*a* and 74*b* act as guides to create a cam action to bias and move selector bar 40 to the right as mechanism 100 moves to the front position in FIG. 7. In FIG. 7, selector post 44 would contact and slide along selector rib 74*b* until the post, and selector bar 40, have moved to the corresponding right position. Similarly in FIG. 6, selector switch 70 would move direction selector bar 40 to the left position against rib 74*a* if bar 40 on mechanism 100 approached (not shown) from the rear in the right position. Selector ribs 74*a* and 74*b* are elongated and angled to provide a low force, gradual cam action as post 44 of selector bar 40 approaches from the rear. The elongated ribs also normally allow immediate actuation for mechanism positions near, but not necessarily at the forward most position since post 44 can remain in contact for such positions.

It is therefore possible for the user to operate switch 70 at any time to select a driving direction. The actual direction change will occur either immediately or upon re-set of the tool to its rest position. Optionally, selector switch 70 or equivalent structure may be positioned elsewhere on the rotary tool. For example, it may be mounted toward the rear or on a side of the tool. In a further option, switch 70, or equivalent structure, may be elongated along a length of the rotary tool, either outside, inside or both (not shown) with respect to housing 10. In the case of an elongated inner switch portion, for example, ribs 74*a* and 74*b* could be elongated to maintain an immediate link to the mechanism for all positions of the mechanism. In this embodiment, the switch may be accessible from various locations of the tool and may immediately act upon direction selector bar 40 or equivalent structure for any or most positions of mechanism 100 as the selector switch provides the external link to internal components.

Figure 10:
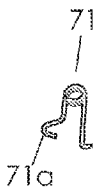
FIG.10 is a top, front perspective view of a switch bias spring.

Selector switch 70 preferably includes pivot post or equivalent structure 72 to fit a corresponding recess or equivalent structure in housing 10 (FIGS. 8, 9). Tab 72*a* locks post 72 in a vertical position. Switch spring 71 presses either side of cam 70*a* at smooth area 71*a* to provide a bias to hold selector switch 70 in a selected position (FIGS. 6, 10). This bias works with the detent bias on direction selector bar 40 described above to maintain a selected position on both movable selector elements. Switch 70 preferably is made from a low friction material such as acetal. A wire spring chosen for switch spring 71 allows a large motion against cam 70*a* so that the switch can toggle between fully moved, stable positions with minimal tendency to hang in a central position. Optionally, a resilient detent may be incorporated into the structure of the switch.

There is preferably an opening or at least an access path from outside to inside the housing 10 at switch 70 to allow the toggle motion of the switch and to allow the switch to communicate external action to the tool interior. Preferably, mechanism 100 and shaft 50 are not substantially visible from outside housing 10 at the location or area of switch 70. The switch or related structure preferably covers, occupies, or otherwise is present at the opening or path. In alternative embodiments, the mechanism may be at least partially visible from outside near switch 70 or elsewhere if desired or required. Mechanism 100 is preferably surrounded or enclosed by housing 10 to a sufficient extent that a user holding the tool cannot, and need not, normally become in contact with the moving mechanism. In any of these embodiments, switch 70 or equivalent structure links a selecting action outside the tool to a subsequent action at mechanism 100. In so linking, switch 70 facilitates the selecting action by providing a readily exposed object upon which the user may directly manipulate. Thus, by generally enclosing the moving components, this helps maintain the internal parts in a clean and debris free environment that minimizes potential causes of a jam or friction.

Re-set spring 90 (FIG. 3) provides a bias to move mechanism 100 to the forward rest position. Spring 90 is preferably a coiled wire spring, and includes a bent portion 95 to fit a slot 35 in curved lever 30 (see FIGS. 23, 28, and 29*a*). A flat bar spring may be used in place of or in addition to the coiled wire spring. The re-set spring 90 is not cross-sectioned in FIG. 23 to better show the entire spring structure. The spring 90 is held laterally in the slot and pivots about bent leg 95 in a recess of curved lever 30 directly above slot 35. No fasteners or further assembly steps are required to fit the spring 90 to curved lever 30. Bent leg 93 pivotally fits a normally circular cavity in housing 10 at a rear of spring 90.

The preferred embodiment rotary tool of the present invention may optionally include a drive bit holder to store an additional such tool or drive bit. FIGS. 30, 30*a*, and 30*b* show tool or drive bit 113 fitted in recess 16 of housing 10. Recess 16 is positioned to allow mechanism 100 to pass in the rear position. Tab 67 of bit latch 61 snap fits behind rib 18 (FIG. 32) to hold the bit latch to the housing. Bit latch 61 pivots about post 66 in housing 10 to normally retain drive bit 113 in the recess. Detent snap feature 69 seen on post 66 allows the bit latch to readily assemble to the housing. Bias arm 63 holds bit latch in the upper position of FIG. 30*a* whereby bit 113 is held in place by the top portion of bit latch 61 that partially, or optionally more fully, confines the bit. A user presses down at tab 64 to move the bit latch downward against the bias of arm 63. In FIG. 31*c* and FIG. 32, arm 63 is deflected accordingly. Within recess 16 there may be ejection arm 14, FIG. 32. Arm 14 biases extra drive bit 113 to rotate out of recess 16 against edge 16*a*, the edge being seen in FIG. 30. In this exemplary embodiment, a single component, one piece molded bit latch 61, provides all the functions required to releasably retain extra drive bit 113 to the tool. Optionally, the bias arms or other elements may be separate components such as metal spring parts.

While particular forms of the invention have been illustrated and described, it will be apparent that various modifications can be made without departing from the spirit and scope of the invention. It is contemplated that elements and structures from one embodiment may be combined or substituted with elements or structures from another embodiment.

What is claimed is:

1. A manually powered rotary tool including a body and a handle extending therefrom, comprising:

a shaft rotatably mounted within the body along a length of the body including a shaft axis;

a slidable ratchet mechanism fitted upon the shaft wherein moving the mechanism along a length of the shaft selectively causes the shaft to rotate, the mechanism substantially enclosed by the body, the mechanism including a first location and a second location along the shaft;

a direction selector of the mechanism operable to determine a direction of rotation of the shaft upon motion of the mechanism, the direction selector moving along with the mechanism within the body;

the handle movable relative to the body, the handle linked to the mechanism wherein moving the handle causes the mechanism to move from the first location toward the second location;

a selector switch mounted to the body and exposed externally on the body, the switch movable between at least two switch positions on the body, the switch normally remaining stationary on the body in one of the two switch positions as the mechanism moves within the body; and the selector switch linked to the direction selector in the first location of the mechanism wherein moving the selector switch causes the direction selector to move to a corresponding position, the selector switch thereby communicating an external action on the switch to the tool interior at the direction selector.

2. The rotary tool of claim 1 wherein, in the second mechanism location, the selector switch is de-linked from the direction selector.

3. The rotary tool of claim 2, wherein the mechanism is adjacent and below the selector switch in the first mechanism location and the mechanism is rearward of the selector switch in the second mechanism location.

4. The rotary tool of claim 1, wherein neither of the mechanism and shaft is substantially visible from outside the body at an area of the body including the selector switch.

5. The rotary tool of claim 2, wherein the selector switch is movable between respective positions when the mechanism is in the second location, and when the switch is so moved the selector switch will not immediately cause the direction selector to move, upon subsequent motion of the mechanism toward the first location the selector switch will force the direction selector to move to the corresponding position.

6. The rotary tool of claim 1, wherein the direction selector includes a selector bar movable transverse to the shaft axis between a left and a right position, and the selector switch presses the selector bar to move the bar.

7. The rotary tool of claim 6, wherein the mechanism includes a cylindrical mechanism housing, the shaft extends within and along a length of the mechanism housing, a ratchet gear surrounds the shaft within the mechanism housing, a resilient arm extends from the selector bar, a latch is pivotally mounted to the mechanism housing, and the resilient arm selectively pivots the latch to engage and disengage the gear.

8. The rotary tool of claim 7, wherein the latch is pivotable about an axis parallel to the shaft axis.

9. The rotary tool of claim 8, wherein the latch engages a tooth of the gear through a large pivot arm length, wherein the tooth engagement is across the shaft axis from the latch pivot axis.

10. The rotary tool of claim 6, wherein the selector switch is pivotally mounted to the housing and movable between a left and a right position.

11. The rotary tool of claim 1, wherein the body includes an access path from outside the body to the mechanism, and the switch occupies an opening of the path to provide external access to the mechanism.

12. A manually powered rotary tool including a body and a handle extending therefrom, comprising:

a shaft rotatably mounted upon a shaft axis within the body along a length of the body;

a spiral ratchet mechanism fitted upon the shaft and substantially enclosed by the body, wherein moving the mechanism along a length of the shaft in a drive direction causes the shaft to rotate, the mechanism including a first location and a second location along the shaft;

a direction selector of the mechanism operable to determine a direction of rotation of the shaft upon motion of the mechanism in the drive direction, the direction selector moving along with the mechanism within the body;

the handle movable upon the body, the handle linked to the mechanism wherein moving the handle causes the mechanism to move from the first location toward the second location;

an access path from outside the body to the mechanism, a selector switch mounted to the body wherein the switch occupies an opening of the path, the switch exposed externally on the body and movable between at least two switch positions on the body, the switch normally remaining stationary on the body in one of the two switch positions as the mechanism and the direction selector move in the drive direction within the body; and the selector switch linked to the direction selector in the first location of the mechanism wherein moving the selector switch causes the direction selector to move to a corresponding position, the selector switch thereby communicating an external action on the switch to the tool interior at the direction selector.

13. The rotary tool of claim 12, wherein the second location of the mechanism includes the direction selector being spaced from and out of contact with the selector switch.

14. The rotary tool of claim 13, wherein the mechanism is adjacent and below the selector switch in the first mechanism location and the mechanism is rearward of the selector switch in the second mechanism location.

15. The rotary tool of claim 12, wherein the selector switch is movable between respective positions when the mechanism is in the second location, and when the switch is so moved the selector switch will not immediately cause the direction selector to move, upon subsequent return motion of the mechanism toward the first location the selector switch will force the direction selector to move to the corresponding position.

16. The rotary tool of claim 15, wherein selector ribs of the switch provide a cam action on the direction selector to move the direction selector as the mechanism moves in the return direction.

17. The rotary tool of claim 12, wherein the selector switch is pivotally mounted to the housing and movable between a left and a right position.

18. The rotary tool of claim 12, wherein a selector bar of the direction selector is slidably mounted to the mechanism and movable transverse to the shaft axis.

19. The rotary tool of claim 17, wherein the switch is resiliently biased to toggle between fully moved stable positions.

20. A manually powered rotary tool, comprising:

an elongated body having a length;

a handle pivoted to the body at an upper handle portion;

a shaft having a shaft axis, rotatably mounted within the body along a length of the body;

a ratchet mechanism reversibly translating along the shaft and substantially enclosed by the body, wherein the ratchet mechanism includes at least two gears and at least two corresponding latches that alternately engage and disengage the gears to control the clockwise and counterclockwise free rotation of the shaft;

a direction selector bar mounted to the ratchet mechanism that translates along a path substantially perpendicular to the shaft axis, that selectively actuates one of the at least two latches;

a curved lever having a first fulcrum and a second fulcrum alternately engaging the upper portion of the handle and pivoted to the ratchet mechanism, wherein squeezing the handle translates the ratchet mechanism;

a re-set spring disposed in the body and biased to at least one of the handle and the curved lever; and a selector switch disposed on an exterior of the body and selectively linked to the direction selector bar to translate the direction selector bar along the path substantially perpendicular to the shaft axis, wherein the selector switch includes a cam that translates the direction selector bar when engaged and when the direction selector comes into engagement.

* * * * *